United States Patent [19]

Takegawa

[11] Patent Number: 4,901,770

[45] Date of Patent: Feb. 20, 1990

[54] AUTOMATIC PICKING CONTROLLING METHOD

[75] Inventor: Yujiro Takegawa, Ishikawa, Japan

[73] Assignee: Tsudakoma Corp., Ishikawa, Japan

[21] Appl. No.: 191,277

[22] Filed: May 6, 1988

[30] Foreign Application Priority Data

May 12, 1987 [JP] Japan ..... 62-113497

[51] Int. Cl.[4] ..... D03D 47/30

[52] U.S. Cl. ..... 139/435 R

[58] Field of Search ..... 139/435, 452, 116

[56] References Cited

U.S. PATENT DOCUMENTS

| | | | |
|---|---|---|---|
| 4,262,707 | 4/1981 | Suzuki . | |
| 4,446,893 | 5/1984 | Gunneman et al. | 139/435 |
| 4,450,876 | 5/1984 | Van Muellekom | 139/435 |
| 4,458,726 | 7/1984 | Wenig | 139/435 |
| 4,550,753 | 11/1985 | Tsuji | 139/435 |
| 4,716,941 | 1/1988 | Takegawa . | |
| 4,732,179 | 3/1988 | Takegawa | 139/435 |
| 4,744,393 | 5/1988 | Takegawa . | |

FOREIGN PATENT DOCUMENTS 164773 12/1985 European Pat. Off. .

*Primary Examiner*—Henry S. Jaudon

*Attorney, Agent, or Firm*—Wenderoth, Lind & Ponack

[57] ABSTRACT

An automatic picking controlling method for automatically controlling the operation of at least the subnozzle groups in a jetting pattern selected on the basis of the actual running mode of a picked weft yarn is arranged such that a plurality of typical jetting patterns respectively corresponding to different running modes of the picked weft yarn for controlling at least the subnozzle groups are initially stored in a storage unit; the running mode of the picked weft yarn is detected in a detection step; a jetting pattern meeting the actual running mode selected from among those stored in the storage unit is read, and the operation of the subnozzle groups is controlled in accordance with the selected jetting pattern for a predetermined period of time.

8 Claims, 3 Drawing Sheets

AUTOMATIC PICKING CONTROLLING METHOD

BACKGROUND OF THE INVENTION

1. Field of the Invention

The present invention relates to a picking device for a fluid jet loom and, more particularly, to a method of automatically controlling the respective jet patterns of subnozzle groups according to the actual running condition (that is, time of arrival) of a picked weft yarn.

2. Description of the Prior Art

U.S. Pat. No. 4,595,039 and EPO publication No. 0164773 (U.S. Pat. No. 4,673,004) disclose a method of automatically controlling the jetting period from the start to the end of a jetting operation of subnozzle groups on the basis of the result of an operation based on a measured weft yarn arrival time which is measured on the weft yarn arrival side of a loom. This prior art method regulates the jetting condition of the subnozzle groups according to the actual running state of a picked weft yarn, particularly, the running speed of a picked weft yarn, and hence stable picking operation is achieved constantly.

However, since this prior art method requires a complicated arithmetic operation by a microcomputer according to a complicated program for every controlling operation, the load on the microcomputer increases excessively when the microcomputer is used also for executing other control operations for controling the loom and restrictions are placed on programming real-time control processes.

It was found from experiments carried out by the applicant of the present application that the variations of the time of arrival of a picked weft yarn is not complicated and that the time of arrival can be classified into several typical running modes. This fact shows that no complicated arithmetic operation for every running mode of a picked weft yarn is necessary for every picking operation and suggests that practically optimum picking operations can be achieved by controlling the jetting operation of the subnozzle groups in several typical jetting patterns regardless of the variations of the physical properties of the weft yarn.

The picking device of an air jet loom picks a weft yarn into a shed by a main nozzle and assists the picked weft yarn in running across the shed by a pluarlity of subnozzles. Ordinarily, the subnozzles are divided into a plurality of subnozzle groups along the running path of the picked weft yarn and the subnozzle groups operate sequentially.

The jetting pattern of the subnozzle groups represented by jet starting time, jet ending time and jet period directly influences the running position of a picked weft yarn. Therefore, the running speed of the picked weft yarn must be taken into consideration in determining the jetting pattern. If the operation of the subnozzle groups is controlled in an inappropriate jetting pattern, the picked weft yarn is unable to run stably, the picked weft yarn will not be inserted satisfactorily, and compressed air is consumed excessively, thereby deteriorating the energy economy of the loom.

SUMMARY OF THE INVENTION

Accordingly, it is an object of the present invention to regulate at least the jetting operation of the subnozzle groups of a picking device of an air jet loom in a practically optimum condition in a plurality of typical jetting patterns without requiring a complicated arithmetic operation in an actual picking control process.

According to the present invention, a plurality of typical jetting patterns for respectively running various modes of picked weft yarns are initially stored in a memory; inasmuch as picking starting angle is determined by the control unit, the time of arrival of the picked weft yarn is not detected but read out; a jetting pattern suitable for the time of arrival of the picked weft yarn is read from the memory, and the jetting operation of the subnozzle groups is controlled on the basis of the jetting pattern for a predetermined period.

Accordingly, at least the subnozzle groups jet compressed air sequentially in the optimum jetting pattern according to the actual running mode of the picked weft yarn. This jetting pattern is stored in the memory as specific data every picking starting phase angle and/or every picking ending phase angle, and an appropriate jetting pattern selected from among those stored in the memory is used according to the actual time of arrival of a picked weft yarn. The actual time of arrival of a picked weft yarn is determined on the basis of the running speed of the picked weft yarn by detecting the picking starting phase angle or the picking ending phase angle.

According to the present invention, when the running characteristics of a picked weft yarn vary due to the variations of the physical properties of the weft yarn, the jetting pattern of the subnozzle groups is regulated automatically to an optimum jetting pattern according to the variations of the actual running mode of the picked weft yarn. Therefore, troubles such as short pick, slack pick and chip trouble are prevented, and a stable picking operation is carried out constantly and energy can be saved through the elimination of useless jetting of compressed air.

Furthermore, the automatic picking controlling method of the present invention flexibly applies also to a control system in which the picking starting phase angle and the picking completion phase angle, i.e., the weft yarn arrival phase angle, are fixed. Accordingly, the optimum control of the picking device of an air jet loom can be achieved by the automatic picking controlling method of the present invention in combination with such a control system.

The above and other objects, features and advantages of the present invention will become more apparent from the following description taken in conjunction with the accompanying drawings.

DETAILED DESCRIPTION OF THE PREFERRED EMBODIMENT

Figure 1:
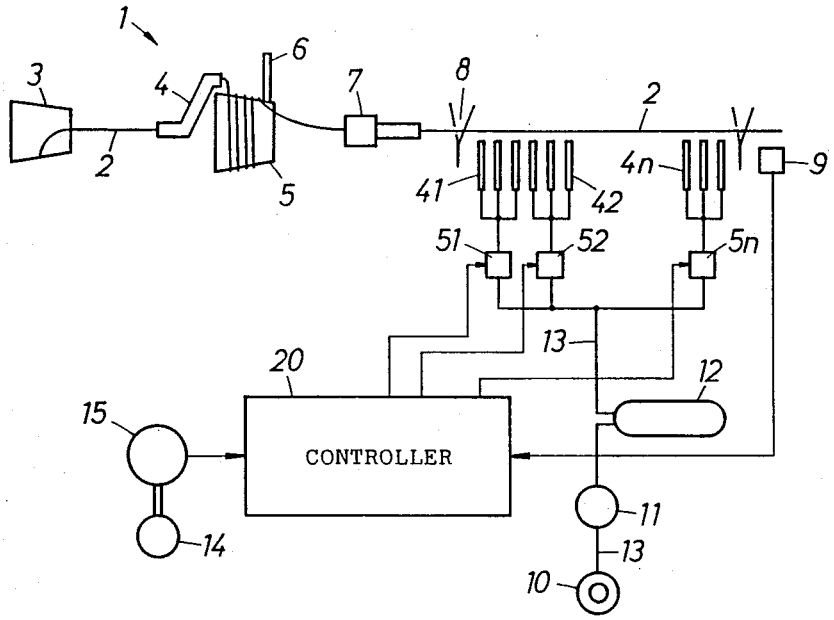
FIG. 1 is a schematic block diagram of a picking device.

A picking device 1 to be controlled by an automatic picking controlling method of the present invention as applied to an air jet loom will be described with reference to FIG. 1 prior to the description of the preferred embodiments of the present invention.

A weft yarn 2 drawn out from a yarn package 3 is passed through a rotary yarn guide 4. The weft yarn 2 is wound around a stationary measuring and storing drum (hereinafter referred to simply as "drum") 5 by the rotary motion of the rotary yarn guide 4 for measuring and storing the weft yarn 2 while a stopper pin 6 is projected to hold the free end of the weft yarn 2 on the circumference of the measuring and storing drum 5. In starting picking operation, the stopper pin 6 is retracted from the circumference of the drum 5 to release the weft yarn 2 from the drum 5, the weft yarn 2 stored on the drum 5 is unwound and is picked into a shed 8 together with a jet of air by a main nozzle 7.

The weft yarn 2 thus picked is assisted for running along a running path by jets of air sent out from n groups of subnozzles 41, 42, . . . , and 4*n* which operate sequentially and is extended tight in the shed 8. During the picking operation, the completion of the picking operation is confirmed by detecting the arrival of the extremity of the picked weft yarn 2 by a weft yarn detector 9 disposed at a weft yarn arrival end of the air jet loom.

To supply compressed air to the subnozzles 41, 42, . . . , and 4*n*, an air supply 10 supplies air through a regulator 11 and a tank 12, and respectively through two-position valves 51, 52, . . . , and 5*n* by an air supply line 13 having branch lines to the inlets of the subnozzles 41, 42, . . . , and 4*n*. The two-position valves 51, 52, . . . , and 5*n* are electromagnetic valves which are controlled individually by a controller 20 according to an automatic picking controlling method of the present invention. The inputs of the controller 20 are connected to the weft yarn detector 9 and a phase angle detector 15 connected to the main shaft 14 of the air jet loom.

Thus, the weft yarn 2 is picked constantly at a fixed picking starting phase angle together with air by the main nozzle 7, and the yarn 2 is assisted for running along the running path by the subnozzles 41, 42, . . . , and 4*n* which are actuated sequentially, and the yarn 2 arrives at an arriving position on the weft yarn arrival side.

Figure 2:
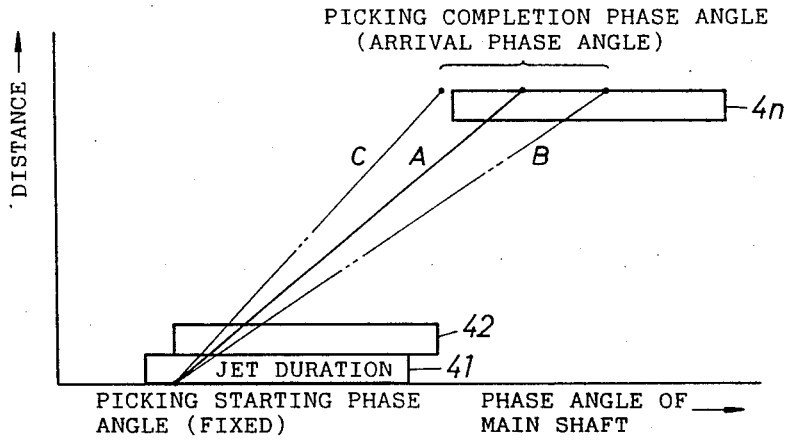
FIG. 2 is a graph for explaining the running characteristics of picked weft yarns.

Referring to FIG. 2, resistance against drawing out the weft yarn 2 varies according to the variations of the condition of the yarn package 3 which occurs when the yarn package 3 is changed for another, the variation of the physical properties of the weft yarn 2 or the vaiation of the size of the yarn package 3. These all tend to vary the tension of the yarn 2 wound on the drum 5. It is apparent that the resistance against drawing out varies according to the wrap tension about drum 5. This tension varies in response to changes in the size of the yarn package 3. The size of the yarn package 3 has nothing whatsoever to do with the number of turns of the weft on drum 5. That is, the physical property (property generated when turning on the drum) of the weft yarn is differentiated depending on the diameter of the package to thereby vary the arrival picking timing. Accordingly, the running mode, particularly, the running speed, of the picked weft yarn 2 is always variable even if the picking condition of the picking device 1 is constant. When the picked weft yarn 2 runs at a standard running speed, the picked weft yarn 2 arrives at the weft yarn detector 9 at a fixed standard picking completion phase angle, i.e., a fixed standard arrival phase angle, as indicated by a straight line A in FIG. 2. When the running speed is lower than the standard running speed, the arrival phase angle is greater than the standard arrival phase angle as indicated by a straight line B in FIG. 2. When the running speed of the picked weft yarn 2 is higher than the standard running speed, the arrival phase angle is smaller than the standard arrival phase angle as indicated by a straight line C in FIG. 2.

While the picked weft yarn 2 is running, the n groups of subnozzles 41, 42, . . . , 4*n* are operated individually and sequntially respectively for predetermined ranges of phase angle as shown in FIG. 2 for the standard running mode of the picked weft yarn 2 indicated by the straight line A to jet compressed air along the running direction of the picked weft yarn 2 to assist the picked weft yarn 2 for running. An optimum jet period, namely, an optimum jet duration defined by an optimum starting phase angle and an optimum jet ending phase angle, must properly be changed in response to the change of the running mode from the standard running mode represented by the straight line A to the retarded running mode represented by the straight line B or to the advanced running mode represented by the straight line C. If the subnozzles 41, 42 . . . , and 4*n* are not properly operated sequentially, the picked weft yarn 2 encounters chip trouble, and is untwisted due to exposure to the jet of air for an excessively long period of time, resulting in a broken pick or is slackened and not extended tight in the shed 8 for unstable vibratory running due to an insufficient jet period.

Figure 3:
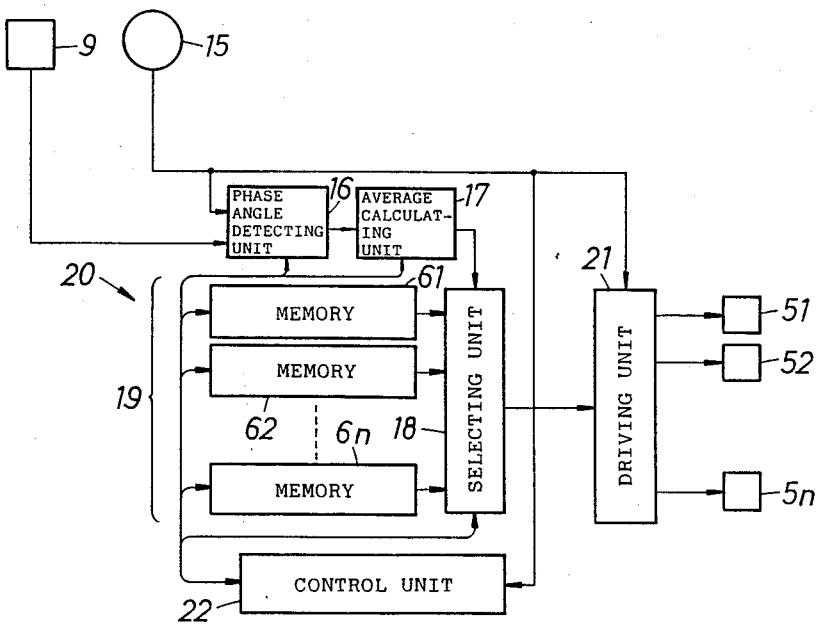
FIG. 3 is a block diagram of a controller for carrying out an automatic picking controlling method, in a first embodiment, according to the present invention.

FIG. 3 shows the essential components of a controller 20, i.e., a computerized controller, for carrying out the picking controlling method of the present invention in an electrical block diagram.

The controller 20 comprises a phase angle detecting unit 16 for detecting the phase angle of the main shaft 14 of the air jet loom, an average calculating unit 17, a selecting unit 18, a storage unit 19, a driving unit 21 for driving the two-position valves 51, 52, . . . , and 5*n*, and a control unit 22 for controlling those component units on the basis of a control program for carrying out the picking controlling method of the present invention.

The weft yarn detector 9 and the phase angle detector 15 are connected to the inputs of the phase angle detecting unit 16. The phase angle detecting unit 16 is connected through the average calculataing unit 17 to one of the inputs of the selecting unit 18. The selecting unit 18 has inputs connected to the memories 61, 62, . . . , and 6*n* of the storage unit 19, and an output connected to the driving unit 21. The driving unit 21 has an input connected to the phase angle detector 16, and outputs connected to the respective manipulators of the two-position valves 51, 52, . . . , and 5*n*.

FIRST EMBODIMENT

Operation of the controller 20 on the basis of the control program for carrying out the automatic picking controlling method will be described hereinafter.

First in a storing step, the operator stores data of jetting patterns represented each by a picking completion phase angle on the basis of typical running characteristics of picked weft yarns 2 in the memories 61, 62, . . . , and 6*n* of the storage unit 19 for every arrival phase angle. During the weaving operation of the air jet loom, the control unit 22 reads a standard jetting pattern (arrival phase angle=200°) from the memory 61 and controls the driving unit 21 to open the two-position valves 51, 52, . . . , and 5*n* sequentially respectively for predetermined jetting periods according to the standard jetting pattern so that the subnozzles 41, 42, . . . , and 4*n* operates sequentially in that order.

Meanwhile, in a phase angle detecting step, the phase angle detecting unit 16 receives a phase angle signal representing a phase angle of the main shaft 14 at the arrival of the picked weft yarn 2 at the weft yarn detector 9 every sampling cycle from the phase angle detector 15 upon the reception of an weft yarn arrival signal from the weft yarn detector 9, and then applies the phase angle signal to the average calculating unit 17. Then, the average calculating unit 17 operates upon the input phase angle signals every calculating cycle, for example, a predetermined number of turns of the main shaft 14 or a predetermines time interval, to calculate an average arrival phase angle, which is applied as an actual picking completion phase angle to the selecting unit 18.

Then, in a selecting step, upon the reception of an instruction from the control unit 22, the selecting unit 18 reads a jetting pattern corresponding to the average arrival phase angle from one of the memories 61, 62, . . . , and 6*n* of the storage unit 19. Suppose that the average arrival phase angle is, for example, 210°, the selecting unit 18 reads the data of the jetting pattern from the memory 62 storing data for a phase angle 210° and applies the data to the driving unit 21.

Then, in the operating step, the driving unit 21 stores the jetting pattern (205°<arrival phase angle≦215°) selected by the selecting unit 18 for the period of the sampling cycle, and opens the two-position valves 51, 52, . . . , and 5*n* sequentially upon the coincidence of the phase angles of the main shaft 14 respectively with operating phase angles defined by the jetting pattern so that the two-position valve 51, 52, . . . , and 5*n* are opened sequentially in that order respectively for predetermined jetting periods to jet compressed air sequentially from the subnozzles 41, 42, . . . , and 4*n*. Thus, the picked weft yarn 2 is assisted for running by jets of compressed air sent out from the subnozzles 41, 42, . . . , and 4*n* so that the picked weft yarn 2 will run in a stable running position and will arrive at the weft yarn detector 9 at the average arrival phase angle.

The arrival phase angle can indirectly be detected on the starting side. Suppose, for example, that four loops of the weft yarn 2 needs to be unwound from the drum 5 for every picking cycle. Then, a phase angle of the main shaft 14 at a moment when the fourth loop of the weft yarn 2 is unwound from the drum is a phase angle slightly before the arrival phase angle.

SECOND EMBODIMENT

In the first embodiment, the picking starting phase angle is, as a rule, fixed and the jetting pattern is changed selectively according to the variation of the average arrival phase angle. This jetting pattern selecting mode is applicable also to automatically controlling the picking starting phase angle in order to enable the picked weft yarn 2 to arrive at a fixed arrival phase angle.

Figure 4:
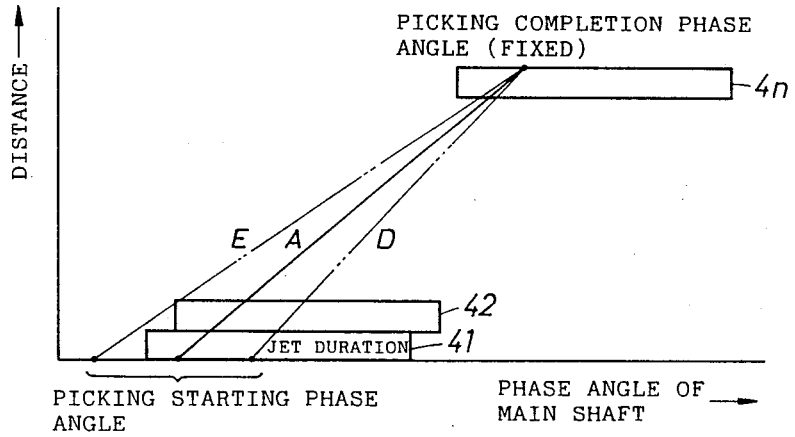
FIG. 4 is a graph for explaining the running characteristics of picked weft yarn picked by a picking device controlled by an automatic picking controlling method, in a second embodiment, according to the present invention.

According to prior art methods disclosed, for example, in Japanese Utility Model Laid-Open Publication No. 60-136379, Japanese Patent Application No. 61-221225 and Japanese Patent Laid-Open Publication No. 60-259652, the jet starting phase angle of the main nozzle 7 or the stopping pin retraction starting phase angle is controlled for automatically controlling the picking starting phase angle to fix the arrival phase angle. If such a control operation is implemented effectively, the standard running characteristics of the picked weft yarn 2 indicated by a straight line A shown in FIG. 4 will vary as indicated by straight lines D and E in FIG. 4. Accordingly, in such a control operation, an optimum jetting pattern must be dependent on the picking starting phase angle. To control the jetting pattern in relation to the picking starting phase angle, the picking starting phase angle may be determined through the detection of the running starting phase angle at which a picked weft yarn 2 starts running by the weft yarn detector 9 disposed, for example, near the extremity of the main nozzle 7 or the picking starting phase angle may be represented by a jet starting phase angle of the main nozzle or a retraction starting phase angle of the stopper pin 6 determined through automatic control operation. Naturally, the memories 61, 62, . . . , and 6*n* of the storage unit 19 stores a plurality of jetting patterns respectively for different picking starting phase angles, when the picking starting phase angle is thus controlled.

In the first embodiment, when the control program is designed so as to translate the straight lines B and C along the axis of phase angle in FIG. 2 to bring the actual arrival phase angle into coincidence with the standard arrival angle, the picking completion phase angle coincides always with the standard arrival phase angle. Accordingly, the automatic picking controlling method of the present invention, as well as the known method mentioned above, is able to control the picking device so that the picking operation is completed at a fixed arrival phase angle.

THIRD EMBODIMENT

As will be understood from the first and second embodiments, the running mode of a picked weft yarn 2 relates substantially to the running speed, and the running mode is represented by the arrival phase angle when the picking starting phase angle is fixed or by the picking starting phase angle when the arrival phase angle is fixed.

However, when both the picking starting phase angle and the picking completion phase angle vary during the picking operation, it is possible to represent the running mode of a picked weft yarn by both the picking starting phase angle and the picking completion phase angle detected simultaneously, and to select a jetting pattern corresponding to the picking starting phase angle and the picking completion phase angle from the storage unit 19. In such a case, the memories 61, 62, . . . , 6*n* of the storage unit 19 stores a plurality of different jetting patterns respectively for different combinations of the picking starting phase angle and the picking completion phase angle.

FOURTH EMBODIMENT

Figure 5:
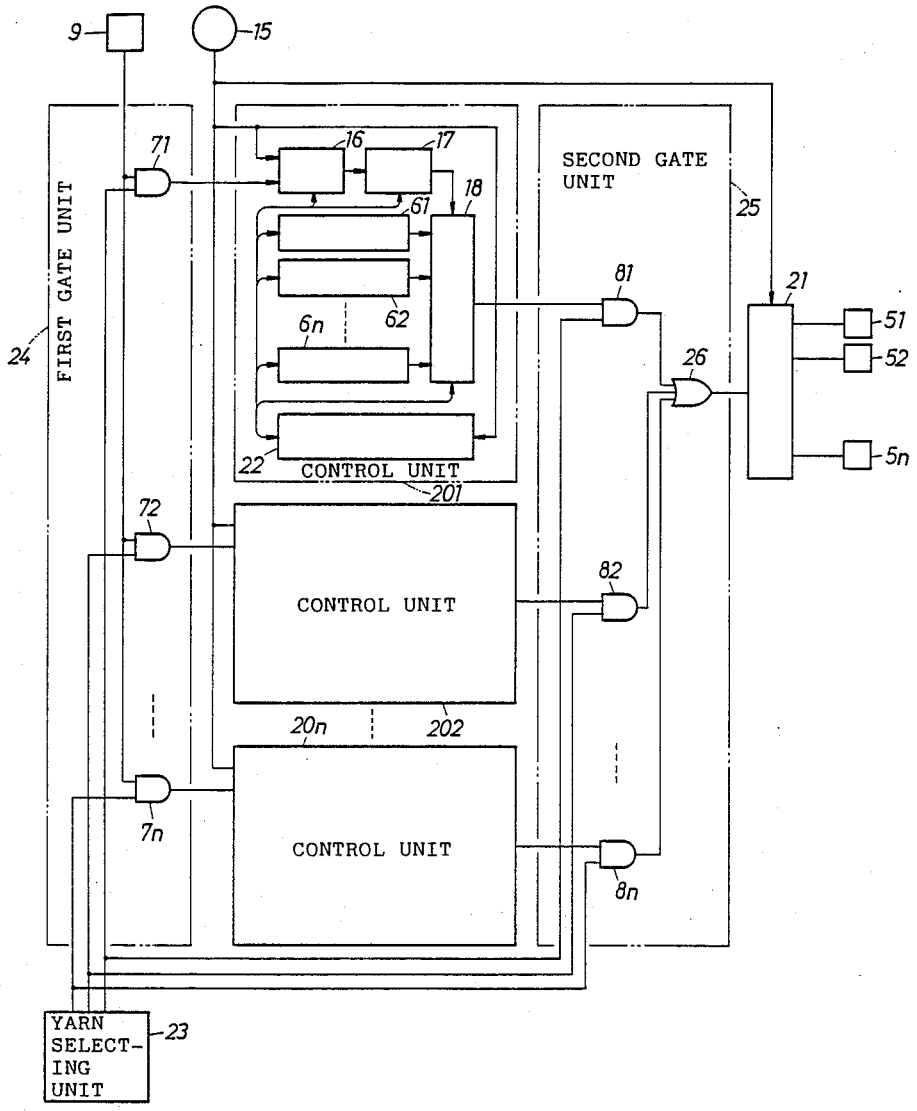
FIG. 5 is a block diagram of a controller for carrying out an automatic picking controlling method, in a third embodiment, according to the present invention.

The foregoing first, second and third embodiments have been described as applied to controlling single-color picking operation. Naturally, the present invention is applicable also to controlling a multicolor picking operation. FIG. 5 shows a controller for the automatic control of picking operation using a plurality of weft yarns 2.

Referring to FIG. 5, the output signal of the weft yarn detector 9 disposed on the arrival side is applied selectively to a phase angle detecting unit 16 corresponding to a picked weft yarn 2 through the AND gate 71, 72, . . . , and 7*n* of a first gate unit 24 which is controlled by a yarn selecting unit 23. One of the two inputs of each of AND gates 81, 82, . . . , and 8*n* of a second gate unit 25 is connected to the yarn selecting unit 23, and the other input of the same is connected to a control unit 201, 202, . . . , or 20*n* corresponding thereto. Upon the reception of a yarn selection signal from the yarn selecting unit 23, the AND gate 81, 82, . . . , or 8*n* applies a signal provided by the corresponding control unit 201, 202, . . . , or 20*n* through an OR gate 26 to a driving unit 21. Then, the driving unit 21 operates so that the subnozzles operate sequentially in a jetting pattern specific to the relevant picked weft yarn among the plurality of weft yarns.

Naturally, the operating modes of the control units 201, 202, . . . , and 20*n* may be the same as any one of the operating modes of the control units of the first, second and third embodiments, or may be different from each other and the same as those of the first, second and third embodiments depending on the type of the related weft yarns.

FIFTH EMBODIMENT

In the foregoing embodiments, at least the subnozzles 41, 42, . . . , and 4*n* are the principal objectives of the control operation. However, the objectives of the control operation are not limited to the subnozzles 41, 42, . . . , and 4*n*, but may include, for example the main nozzle 7 or a stretching nozzzle disposed on the arrival side. Furthermore, the retraction starting phase angle at which the stopper pin 6 is retracted may be controlled to fix the arrival phase angle.

Although the invention has been described in its preferred form with a certain degree of particularity, it is to be understood that many variations and changes are possible in the invention without departing from the scope thereof.

What is claimed is:

1. An automatic picking controlling method for controlling the picking operation of a picking device having a main nozzle for picking a weft yarn by a jet of fluid, and a plurality of subnozzles arranged in groups which assist a picked weft yarn for running along a running path by jets of fluid, the method comprising the following steps:

a storing step for initially storing a plurality of accessible jetting patterns for each of the groups of the plurality of subnozzles, each of the patterns respectively corresponding to a running mode of the picked weft yarn;

a detecting step for detecting the actual running mode of the picked weft yarn during a picking operation;

a reading step for selectively reading a jetting pattern corresponding to the actual detected running mode selected from among the initially stored jetting patterns; and a controlling step for controlling the operation and duration of operation of the subnozzles according to the selected jetting pattern.

2. An automatic picking controlling method according to claim 1, wherein, in a multicolor picking operation, the respective actual running modes of different types of weft yarns are detected individually in said detecting step, and a plurality of respective jetting patterns for the different types of weft yarns are read selectively and individually in said reading step.

3. An automatic picking controlling method according to claim 1, wherein the actual running mode of the picked weft yarn is represented by an actual picking completion phase angle detected in said detecting step when the picking starting phase angle is fixed.

4. An automatic picking controlling method according to claim 2, wherein the actual running mode of the picked weft yarn is represented by an actual picking starting phase angle detected in said detecting step when the picking starting phase angle is fixed.

5. An automatic picking controlling method according to claim 1, wherein the actual running mode is represented by an actual picking completion phase angle detected in said detecting step when the picking completion phase angle is fixed.

6. An automatic picking controlling method according to claim 2, wherein the actual running mode is represented by the actual picking starting phase angle detected in said detecting step when the picking completion phase angle is fixed.

7. An automatic picking controlling method according to claim 1, wherein the actual running mode of the picked weft yarn is represented by an actual picking completion phase angle and an actual picking starting phase angle detected in said detecting step.

8. An automatic picking controlling method according to claim 2, wherein the actual running mode of the picked weft yarn is represented by an actual picking completion phase angle and an actual picking starting phase angle detected in said detecting step.

* * * * *